US009217271B2

(12) United States Patent
Heissler

(10) Patent No.: US 9,217,271 B2
(45) Date of Patent: Dec. 22, 2015

(54) METHOD FOR MOTORIZED MOVEMENT OF A MOTOR VEHICLE DOOR

(75) Inventor: Horst Heissler, Gerolfing (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 1014 days.

(21) Appl. No.: 12/130,620

(22) Filed: May 30, 2008

(65) Prior Publication Data

US 2008/0295408 A1 Dec. 4, 2008

(30) Foreign Application Priority Data

May 31, 2007 (DE) ..... 10 2007 025 518

(51) Int. Cl.
*E05F 15/619* (2015.01)

(52) U.S. Cl.
CPC ..... *E05F 15/619* (2015.01); *E05Y 2201/214* (2013.01); *E05Y 2201/246* (2013.01); *E05Y 2201/414* (2013.01); *E05Y 2201/424* (2013.01); *E05Y 2201/434* (2013.01); *E05Y 2201/462* (2013.01); *E05Y 2201/712* (2013.01); *E05Y 2201/722* (2013.01); *E05Y 2400/356* (2013.01); *E05Y 2400/44* (2013.01); *E05Y 2600/46* (2013.01); *E05Y 2900/508* (2013.01); *E05Y 2900/531* (2013.01)

(58) Field of Classification Search
USPC ..... 49/506, 340
IPC ..... E05F 15/619; E05Y 2900/531,2400/44, E05Y 2201/414, 2600/46, 2201/214
See application file for complete search history.

(56) References Cited

U.S. PATENT DOCUMENTS

| | | | | | |
|---|---|---|---|---|---|
| 3,653,154 | A | * | 4/1972 | Hayday | 49/280 |
| 3,735,531 | A | * | 5/1973 | Kramer | 49/362 |
| 4,264,849 | A | * | 4/1981 | Fleischer et al. | 318/568.1 |
| 4,272,923 | A | * | 6/1981 | Anderson | 49/360 |
| 4,403,449 | A | * | 9/1983 | Richmond | 49/340 |
| 4,618,132 | A | * | 10/1986 | Kimura et al. | 296/152 |
| 4,640,050 | A | * | 2/1987 | Yamagishi et al. | 49/280 |
| 4,869,537 | A | * | 9/1989 | Compeau et al. | 292/341.18 |

(Continued)

FOREIGN PATENT DOCUMENTS

| | | |
|---|---|---|
| DE | 39 00 508 A1 | 8/1989 |
| DE | 41 40 197 A1 | 6/1993 |

(Continued)

OTHER PUBLICATIONS

German Search Report in corresponding DE 102007025518.9, dated Nov. 19, 2007.

(Continued)

*Primary Examiner* — Gregory Strimbu
(74) *Attorney, Agent, or Firm* — Andrus Intellectual Property Law, LLP

(57) ABSTRACT

A method of motorized movement of a vehicle door, wherein the vehicle door can be moved from an open position to a closed position as part of a closing process with a door drive mechanism associated with the vehicle door and a control system. In a first section of the closing process the vehicle door is moved by the door drive mechanism from the open position to a comfortable open position that lies between the open position and the closed position. In a second section of the closing process, the vehicle door is further moved from the comfortable open position in the closing direction, preferably to the closed position, manually by the user and largely free of the door drive mechanism.

9 Claims, 2 Drawing Sheets

(56) References Cited

U.S. PATENT DOCUMENTS

| | | | | | |
|---|---|---|---|---|---|
| 5,071,160 | A * | 12/1991 | White et al. | 280/735 |
| 5,189,839 | A * | 3/1993 | DeLand et al. | 49/360 |
| 5,443,292 | A * | 8/1995 | Shimada et al. | 292/341.16 |
| 5,708,338 | A * | 1/1998 | Cook et al. | 318/466 |
| 5,878,530 | A * | 3/1999 | Eccleston et al. | 49/139 |
| 5,910,075 | A * | 6/1999 | Arnell et al. | 49/25 |
| 6,199,322 | B1 * | 3/2001 | Itami et al. | 49/139 |
| 6,321,488 | B1 * | 11/2001 | Bigoszewski et al. | 49/358 |
| 6,478,357 | B2 * | 11/2002 | Zhou | 296/56 |
| 6,929,310 | B2 * | 8/2005 | Okada | 296/146.8 |
| 6,964,449 | B2 * | 11/2005 | Takeda et al. | 296/146.4 |
| 7,292,152 | B2 * | 11/2007 | Torkkola et al. | 340/576 |
| 7,644,540 | B2 * | 1/2010 | Ichinose | 49/360 |
| 7,774,983 | B2 * | 8/2010 | Shimura et al. | 49/341 |
| 7,791,476 | B2 * | 9/2010 | Hawkins et al. | 340/561 |
| 7,808,197 | B2 * | 10/2010 | Kimura et al. | 318/469 |
| 7,959,204 | B2 * | 6/2011 | Yoshida | 296/56 |
| 2003/0200019 | A1 * | 10/2003 | Grabowski et al. | 701/45 |
| 2004/0256881 | A1 * | 12/2004 | Takeda et al. | 296/146.2 |
| 2005/0033503 | A1 * | 2/2005 | Yamamoto | 701/114 |
| 2005/0151379 | A1 | 7/2005 | Brose et al. | |
| 2005/0173219 | A1 * | 8/2005 | Bittner et al. | 192/84.31 |
| 2005/0277512 | A1 | 12/2005 | Gueler et al. | |
| 2006/0042165 | A1 * | 3/2006 | Baczewski et al. | 49/334 |
| 2006/0108167 | A1 * | 5/2006 | Finger | 180/268 |
| 2007/0175099 | A1 * | 8/2007 | Kachouh | 49/340 |
| 2007/0214725 | A1 * | 9/2007 | Miyashita | 49/340 |
| 2007/0285219 | A1 * | 12/2007 | Greene | 340/457.1 |
| 2008/0216409 | A1 * | 9/2008 | Bochen et al. | 49/340 |
| 2009/0139146 | A1 * | 6/2009 | Houser et al. | 49/340 |
| 2010/0115853 | A1 * | 5/2010 | Gebhart et al. | 49/506 |
| 2010/0313477 | A1 * | 12/2010 | McKee et al. | 49/28 |
| 2011/0060466 | A1 * | 3/2011 | Tandrow et al. | 700/275 |
| 2011/0072726 | A1 * | 3/2011 | Boecker | 49/356 |
| 2011/0094160 | A1 * | 4/2011 | Houser | 49/31 |

FOREIGN PATENT DOCUMENTS

| | | | | |
|---|---|---|---|---|
| DE | 196 15 021 | A1 | 10/1997 | |
| DE | 100 23 259 | B4 | 9/2004 | |
| DE | 20 2004 016542 | U1 | 10/2005 | |
| FR | 2649747 | A1 * | 1/1991 | E05F 15/20 |
| WO | WO 9004526 | A1 * | 5/1990 | B60J 5/04 |

OTHER PUBLICATIONS

European Search Report in corresponding EP. 08009297, dated Mar. 21, 2011.

* cited by examiner

METHOD FOR MOTORIZED MOVEMENT OF A MOTOR VEHICLE DOOR

CROSS-REFERENCE TO RELATED APPLICATIONS

This application claims priority of German Patent Application No. 10 2007 025 518.9, filed May 31, 2007, which application is incorporated herein by reference.

BACKGROUND

The invention pertains to a method for the motorized movement of a vehicle door as well as a vehicle door apparatus with a vehicle door.

The term "vehicle door" is understood to be comprehensive here. It encompasses side doors, as well as rear doors, rear lids, rear covers, engine compartment hoods or trunk lids. The vehicle door can be a swinging door or a sliding door. The entirety of the following discussion is about a side door designed as a swinging door, which is not understood to be limiting.

As the functionality of vehicle doors has become more and more dense in recent years, the weight of the vehicle doors has also continued to increase. A particular result of this is that manual closing of the doors, which the user performs from inside the vehicle in the sitting position, can be uncomfortable depending on the respective geometric conditions.

What has shown to be particularly uncomfortable is a vehicle door apparatus that is used in Coupe vehicle chassis types specifically. In such an arrangement, vehicle doors extend considerably in the longitudinal direction of the vehicle, which makes it much more difficult for users who are in the sitting position inside the vehicle to close them. This is because the door actuation handle located on the inside of the vehicle door and through which the actuation force of the user is introduced to the vehicle door is often far away from the user when the vehicle door is open. The user must perform considerable contortions, depending on his body size, in order to reach the door actuation handle.

A proposed solution has been to equip the vehicle door with a door drive mechanism that can move the vehicle door from the open position in the direction of closing as part of a motorized closing process. The known vehicle door apparatus (US 2005/0277512 A1), upon which the invention is based shows just such a door drive mechanism, which allows for purely manual movement of the vehicle door in addition to motorized movement.

Indeed, the known vehicle door apparatus provides a high degree of user comfort with its associated method of motorized movement, since the user does not have to apply any actuation force during the closing process.

However, the implementation effort for the known vehicle door apparatus is considerable. The reason for this is first of all that high counter-torques occur during the closing process just before reaching the closed position, said torques arising due to the engagement between a vehicle door lock associated with the vehicle door and a lock catch associated with the vehicle chassis, as well as due to gasket counter-pressures.

With regard to the counter-torques mentioned above, in general a closure aid is used that takes over the movement of the vehicle door from a pre-closed position, which is located just before the closed position, to the closed position. In the process, this aid can be a drive mechanism of the latch bolt of the vehicle lock or a drive mechanism of the lock catch. The latter variation is explained in US 2005/0151379 A1.

Finally, a vehicle door apparatus is known (DE 100 23 259 B4) in which the automatic movement of the vehicle door is done on the one hand by the door drive mechanism and on the other by momentum shortly before reaching the closed position. Here, as well, the effort to implement is considerable.

In addition to the high design effort, in the known motorized closing process it is a disadvantage that there is always a certain amount of pinch danger present. The possibility of the user getting an arm or a leg in the pinch area is simply impossible to eliminate.

SUMMARY

The invention deals with the problem of designing and advancing the known method of motorized movement of a vehicle door and the known vehicle door apparatus such that the effort of implementation is reduced while maintaining sufficient user comfort.

The important innovation is to make the vehicle door closing process partially motorized and partially manual. In the process, what was recognized is that in order to provide considerable user comfort, it is sufficient to only move the vehicle door using a motor in a first section of the closing process. In the process, the door drive mechanism moves the vehicle door from the open position to a so-called "comfortable open position" that lies in between the open position and the closed position. Then, the user moves the vehicle door manually and for the most part free of the door drive mechanism in a second section of the closing process. This manual movement is a movement of the vehicle door from the comfortable open position in the direction of the closed position.

The closing process for the vehicle door is thus subdivided into two sections, only the first section of which involving a motorized movement of the vehicle door in the above sense.

After the user gets in, the door drive mechanism brings the vehicle door to the comfortable open position, which is placed such that the door actuation handle is comfortably reached by the user. The further manual part of the closing process can then be carried out by the user without serious effort.

What is important here is the fact that the second section of the closing process can occur largely free of the door drive mechanism. "Largely free" is understood to mean that in the second section of the closing process, i.e. during manual movement of the vehicle door, the existence of the door drive mechanism is not or is only slightly noticed by the user. This can be implemented in a first preferred embodiment by separating the door drive mechanism mechanically from the vehicle door in the second section of the closing process.

Another interesting aspect further involves the initiation of the closing process through certain user actions that are not originally associated with the vehicle door, such that the initiation of the closing process is generally done by the user unconsciously. For example, what can happen is that the closing process is done by the occupation of the vehicle seat associated with the vehicle door.

Reference may be made to the full scope of the above embodiments of the proposed method.

A preferred embodiment comprises the modification of the translational relationship between the door drive mechanism and the vehicle door when transitioning from the first section to the second section of the closing procedure such that the user does not notice any reaction of the door drive mechanism to the vehicle door.

BRIEF DESCRIPTION OF THE DRAWINGS

The invention is explained in more detail below with the aid of the drawing, which illustrates only one exemplary embodiment. Shown in the drawing are.

DETAILED DESCRIPTION OF THE DRAWINGS

Figure 1:
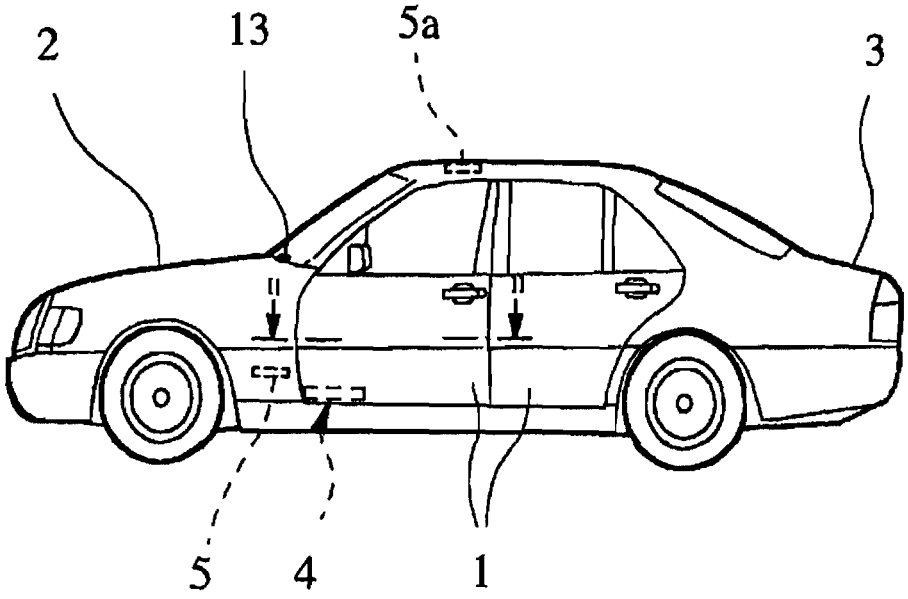
FIG. 1A side view of a vehicle with a vehicle door apparatus as proposed

The vehicle shown in FIG. 1 is equipped with a vehicle door apparatus as proposed, said apparatus comprising four sides 1, one engine compartment hood 2 and one trunk lid 3 and provided to carry out the method proposed.

Depending on the design, a sliding door or the like could be provided instead of a swinging side door. Each of the side doors 1, the engine compartment hood 2, the trunk lid 3 and the sliding door or the like, if present, is a vehicle door in the present sense. Below, the side door 1 only will represent all identified types of vehicle doors. This is preferred but not to be understood as limiting.

The vehicle door 1 can be moved from an open position to a closed position during a closing process, wherein a door drive mechanism 4 associated with the vehicle door 1 and an electrical control system 5 are provided. During the closing process, the vehicle door 1 is movable starting from the open position in the direction of closing via the door drive mechanism 4. Here, what is discussed is only the closing process for the vehicle door 1. The opening process can be done via a motor or manually regardless of the special configuration of the closing process.

Figure 2A:
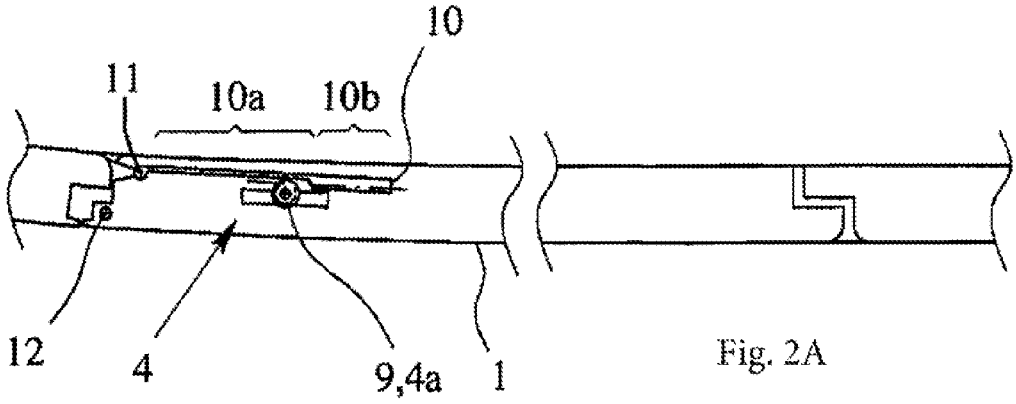
FIG. 2A The vehicle according to FIG. 1 in a sectional view along section II-II for a vehicle door located in the closed position and FIG. 2B The vehicle according to FIG. 1 in a sectional view along section II-II for a vehicle door located in the open position.
Figure 2B:
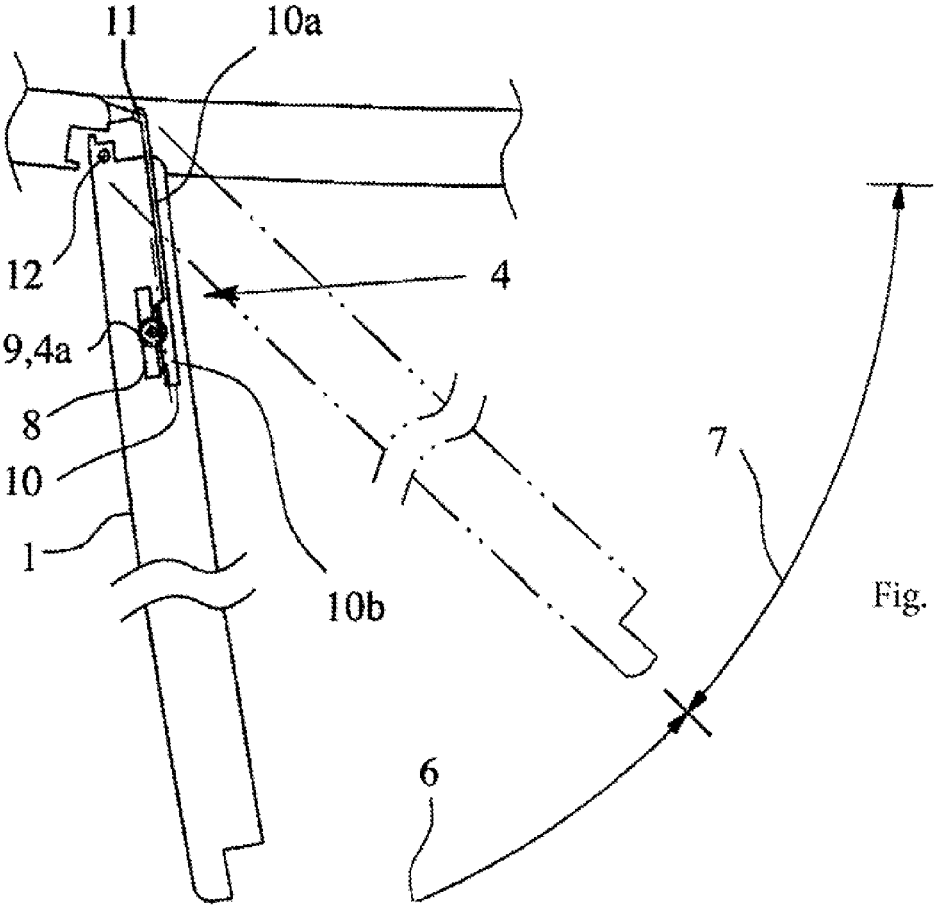

What is important is that the apparatus is designed such that in a first section 6 of the closing process the door drive mechanism 4 moves the vehicle door 1 from the open position (in FIG. 2B below) to a comfortable open position (in FIG. 2B shown as a dashed line) that is between the open position and the closed position. Furthermore, it is important that in a second section 7 of the closing process, the vehicle door can be further moved starting from the comfortable open position in the direction of closing, preferably into the closed position, manually and largely free of the door drive mechanism 4. Basically, a closure aid can also be provided here such that the manual movement is only necessary up to a pre-closed position. This is explained further below.

Addressed above was the fact that the vehicle door 1 can be designed as a swinging door (FIG. 1,2A,2B) or as a sliding door. For a sliding door, the same problems with the closing process occur as identified above, in particular when the sliding door is associated with the driver side.

The geometric extent of the first section 6 of the closing process on the one hand and the second section of the closing process on the other is of particular importance for user comfort and effort to implement. The location of the comfortable open position is a critical parameter for this.

Preferably, the comfortable open position is located in an area between 25% and 85%, preferably between 30% and 70%, more preferably between 35% and 55%, of the swinging range of the vehicle door, as seen from the closed position in the direction of opening.

It was explained in the general section of the description that the comfortable open position is ultimately placed such that the door actuation handle can be comfortably reached by the user. However, this can be subject to considerable deviations depending on the body size of the user. Accordingly, in another preferred embodiment it is provided that the location of the comfortable open position is adjustable. What is conceivable here is a mechanical adjustment, for example by moving a stop or the like. However, it is also conceivable to have an electrical adjustment, such as by changing the controls of a coupling or the like, if provided.

In the embodiment shown in FIGS. 2A, 2B and as such the preferred embodiment, it is provided that the door drive mechanism 4 be separated mechanically from the vehicle door 1 in the second section 7 of the closing process so that in the second section 7 of the closing process the vehicle door 1 can be moved manually and largely free of the door drive mechanism 4.

Here, preferably, the door drive mechanism 4 is a rack-and-pinion drive mechanism. The door drive mechanism 4 comprises a drive motor 8 located in a cavity in the vehicle door 1, said motor driving a pinion 9. The pinion 9 meshes with a rack 10 that is swingably attached to the vehicle chassis at a hinge point 11. The hinge point 11 is located at such a distance away from the swing axis 12 of the vehicle door that driving the pinion 9 along the rack 10 results in the swinging of the vehicle door 1.

What is important is only the fact that an element 9 of the door drive mechanism 4, in this case the pinion 9, disengages mechanically from an element 10 of the vehicle door 1, in this case the rack 10, due to the movement of the vehicle door 1 in the direction of closing beyond the comfortable open position, thus resulting in the mechanical separation of the door drive mechanism 4 from the vehicle door 1. To this end, the rack 10 comprises a section 10*a* with a free section without cogging and a section 10*b* with the usual cogging.

In the first section 6 of the closing process, the pinion 9 is engaged mechanically with the rack 10, in particular with section 10*b*, so that it is possible to move the vehicle door 1 from the open position to the comfortable open position using the door drive mechanism 4.

In the comfortable open position, shown in FIG. 2B in a dashed line, the pinion 9 disengages mechanically from the cogging of section 10*b* of the rack 10 so that the rack 10 can be moved away from the pinion when it is further moved in the direction of closing. The pinion 9 then passes through section 10*a* comprising the free section. This makes the vehicle door 1 in its entirety moveable, and largely free from the door drive mechanism 4, if one neglects the inconsequential motion of the rack 10 along with the door.

The embodiment shown in FIGS. 2A, 2B and as such the preferred embodiment, is simple and robust. Basically, however, a coupling 4*a* could be placed between the door drive mechanism 4 and the vehicle door 1, and the mechanical separation in the comfortable open position could be accomplished using the coupling 4*a*. In the process, the coupling 4*a* is preferred to be designed as an electrically switchable coupling. A coupling 4*a* is shown schematically in the drawing. The coupling 4*a* shown there is integrated into the pinion 9 of the door drive mechanism 4 to a certain extent.

In another preferred embodiment, mechanical transitions or couplings can be completely eliminated. Here, the door drive mechanism 4 comprises a coupling mechanism to transfer the driving force between the vehicle door 1 and the vehicle chassis, and the translation of the coupling mechanism changes with the movement of the vehicle door 1 in the direction of closing beyond the comfortable open position such that in the second section 7 of the closing process the vehicle door 1 can be moved manually and largely free of the door drive mechanism 4. An example for such a coupling mechanism would be a four-bar linkage mechanism, for example, provided that it is designed in a suitable way.

A particularly compact embodiment results from the door drive mechanism 4 being combined with other components of the vehicle door 1. In an especially preferred embodiment, the door drive mechanism 4 is part of a door fastener. This can be easily accomplished in the embodiment shown in FIG. 2A, 2B by braking the pinion 8 for the vehicle door 1 located in the open position, for example.

The optimum control of the door drive mechanism 4 is of particular importance. In particular, when the transition is made from the first section 6 to the second section 7 of the closing process, the door drive mechanism 4 must be shut off, and the coupling 4*a* may have to be switched. These procedures are preferred to be effected by the control system 5. Basically, it is also conceivable that the control system 5 makes pre-determined speed gradients in the motorized movement of the vehicle door 1.

The initiation of the closing process is especially important when it comes to the level of user comfort attainable. In a simple setup, an activation element 13 coupled to the control system 5 is provided inside the vehicle to initiate the closing process.

Basically, however, it is also conceivable that the initiation of the closing process can be done by the user unconsciously. In the process, first of all the control system 5 detects some of the user actions inside the vehicle and initiates the closing process when a pre-determined user action or a pre-determined combination of user actions exists. In the process, in an especially preferred embodiment, these user actions that initiate the closing process are not originally associated with the vehicle door 1 so that the initiation of the closing process by the user occurs unconsciously, in general. Advantageously, the user action or actions that initiate the closing process proceeds or proceed without actively operating an electronic control element or the like, in particular remote controls.

For example, it is preferable for the control system 5 to use a sensor apparatus 5*a* to detect when a vehicle seat is occupied, preferably the vehicle seat associated with the vehicle door, and that the detection of this user action be a necessary, and preferably sufficient, condition for the initiation of the closing process for the vehicle door. By "necessary", it is meant that another user action may have to be detected by the control system 5 for the closing process to be initiated. By "sufficient", it is meant that this detection of user action is enough to initiate the closing process. Based on these necessary or sufficient conditions, a decision is made in the control system 5, depending on the respective sensory detection, as to whether the closing process is to be initiated or not.

In the preferred embodiment, the control system 5 detects the user's entering the vehicle via a sensor apparatus 5*a* and the detection of this user action is a necessary, and preferably sufficient, condition for the initiation of the closing process.

In general, it is not sufficient to detect the entry of a user into the vehicle to initiate the closing process. In many cases, the user will not yet be completely situated in the vehicle, so that there is the basic danger of pinching. Therefore, it is preferable that additional user actions, such as the occupation of a vehicle seat as described above, in order for the closing process to be initiated.

It is especially advantageous if the control system 5 detects the locking of a safety belt by means of a sensor apparatus 5*a* and that the detection of this user action is again necessary, and preferably sufficient, to initiate the closing process.

In another preferred embodiment, a steering wheel lock is provided, wherein the control system 5 detects the unlocking of the steering wheel lock via a sensor apparatus 5*a* and that the detection of this user action is a necessary, and preferably sufficient, condition for the initiation of the closing process.

For modern vehicles, electric engine starting buttons are increasingly provided with which to start the engine of the vehicle, wherein the control system 5 detects the actuation of the engine starting button, and wherein the detection of this user action is a necessary, and preferably sufficient, condition for the initiation of the closing process.

Usually, a hand brake lever is provided in a vehicle as well. In the preferred embodiment, the control system 5 detects the release of the hand brake lever via a sensor apparatus 5*a*, and the detection of this user action is a necessary, and preferably sufficient, condition for the initiation of the closing process.

In general, a gear shift lever of some type is also provided inside the vehicle, wherein the control system 5 detects the engagement of a gear of a manual transmission or the engagement of drive mode in an automatic transmission via a sensor apparatus 5*a*, wherein the detection of this user action is again a necessary, and preferably sufficient, condition for the initiation of the closing process.

Further, there is generally a pedal on the driver side of the vehicle, in particular a clutch pedal. In the process, it is preferably for the control system 5 to detect the actuation of the pedal via a sensor apparatus 5*a*, wherein the detection of this user action is a necessary, and preferably sufficient, condition for the initiation of the closing process.

Explicit reference may be made to the fact that preferably the detection of two or more user actions in combination, preferably two or more of the user actions identified above, initiate the closing process. Here, a largely arbitrary combination of the use actions described above is conceivable.

In particular, the detection of user actions occurring one after the other can result in an initiation of the closing process. An example for this is the detection of the entry of the user into the vehicle and the detection of the locking of the safety belt. In the process, additionally the initiation of the closing process does not occur if the time between the two user actions is unusually long. In the process, use is made of the commonly applied times between the respective user actions.

Depending on which user action effects the initiation of the closing process, it can be advantageous that the control system 5 initiates the closing process following the detection of the user action or actions that initiates or initiate the closing process only after a pre-determined time delay, one that is preferably adjustable by the user. This is particularly advantageous for the user action of occupying the vehicle seat.

Further explained above is that the proposed vehicle door apparatus can also be combined with a closure aid. Provided for this purpose is first of all another position of the vehicle door, namely the pre-closed position. The pre-closed position is right before the closed position, and indeed such that high gasket counter-pressures are not yet in effect in the pre-closed position. When the vehicle door is in the pre-closed position, there is only a small gap remaining between the vehicle door and the vehicle chassis. With regard to a possible embodiment of a closure aid, reference is again made to US 2005/0151379 A 1.

In the second section of the closing process, the vehicle door 1 is then manually moveable to the pre-closed position in the direction of closing manually and largely free of the door drive mechanism 4 starting from the comfortable open position. The motorized closure aid then continues the closing process accordingly, which moves the vehicle door 1 from the pre-closed position to the closed position.

In the proposed method, the vehicle door 1 can be moved from an open position to a closed position as explained above as part of a closing process, wherein a door drive mechanism 4 associated with the vehicle door is provided and wherein the vehicle door 1 can be moved in the direction of closing starting from the open position by means of the door drive mechanism 4. This was explained above as well.

What is important is that in the first section of the closing process the vehicle door 1 is moved by the door drive mechanism 4 from the open position to the comfortable open position as explained, which lies between the open position and the closed position, and that in a second section of the closing process, the vehicle door 1 is moved from the comfortable open position in the direction of closing, preferably to the closed position, manually by the user and largely free of the door drive mechanism. Here, preferably, the vehicle door is moved only when the user has manually undertaken this movement as part of the closing process after the first section has finished.

What is claimed is:

1. A method of moving a vehicle door, the method comprising:

providing a control system and a door drive mechanism associated with the vehicle door;

setting a predetermined open position that lies between an open position of the vehicle door and a closed position of the vehicle door, wherein the predetermined open position being a mechanically or electrically adjustable set position dependent upon a preference of a user;

manually moving the vehicle door in an opening direction from the closed position to the open position;

completing a first section of a closing process by moving the vehicle door in a closing direction from the open position toward the closed position using the door drive mechanism;

automatically ending movement of the vehicle door by the door drive mechanism at the predetermined open position; and completing a second section of the closing process by manually moving the vehicle door, largely free of the door drive mechanism, in the closing direction from the predetermined open position to the closed position.

2. The method of claim 1, further comprising:

mechanically separating the door drive mechanism from the vehicle door during the second section of the closing process.

3. The method of claim 2, wherein the step of mechanically separating the door drive mechanism from the vehicle door comprises disengaging a first element of the door drive mechanism from a second element of the vehicle door by moving the vehicle door in the closing direction beyond the predetermined open position.

4. The method of claim 1, wherein the predetermined open position is located between 25% and 85% of a swing range of the vehicle door from the closed position toward the open position.

5. The method of claim 1, wherein a coupling is located between the door drive mechanism and the vehicle door and the method further comprises:

mechanically separating the door drive mechanism from the vehicle door at the coupling when the vehicle door is in the predetermined open position.

6. The method of claim 1, further comprising:

shutting off the door drive mechanism with the control system when transitioning from the first section of the closing process to the second section of the closing process.

7. The method of claim 1, further comprising:

detecting, at least in part with the control system, at least one predetermined user action after the step of manually moving the vehicle door to the open position; and upon detection of said predetermined user action, initiating the first section of the closing process.

8. The method of claim 7, further comprising:

detecting said at least one user action with a sensor apparatus, wherein the at least one user action comprises occupation of a vehicle seat associated with the vehicle door.

9. The method of claim 7, wherein a predetermined time delay occurs after the detection of the predetermined user action and before the step of initiating the first section of the closing process.

* * * * *